US010634286B2

(12) United States Patent
Cao et al.

(10) Patent No.: US 10,634,286 B2
(45) Date of Patent: Apr. 28, 2020

(54) LIGHTING DEVICE AND MANUFACTURING METHOD THEREOF

(71) Applicant: Leedarson Lighting Co., Ltd., Zhangzhou, Fujian (CN)

(72) Inventors: Liangliang Cao, Fujian (CN); Xiaobo Chen, Fujian (CN)

(73) Assignee: LEEDARSON LIGHTING CO., LTD., Zhangzhou, Fujian (CN)

( * ) Notice: Subject to any disclaimer, the term of this patent is extended or adjusted under 35 U.S.C. 154(b) by 0 days.

(21) Appl. No.: 15/835,135

(22) Filed: Dec. 7, 2017

(65) Prior Publication Data

US 2019/0041007 A1 Feb. 7, 2019

(30) Foreign Application Priority Data

Aug. 7, 2017 (CN) ..... 2017 1 0665013

(51) Int. Cl.

| | |
|---|---|
| ***F21K 9/235*** | (2016.01) |
| ***F21K 9/237*** | (2016.01) |
| ***F21K 9/232*** | (2016.01) |
| ***F21K 9/90*** | (2016.01) |
| ***F21Y 115/10*** | (2016.01) |
| ***F21V 3/00*** | (2015.01) |
| ***F21Y 107/00*** | (2016.01) |

(52) U.S. Cl.

CPC ..... *F21K 9/235* (2016.08); *F21K 9/232* (2016.08); *F21K 9/237* (2016.08); *F21K 9/90* (2013.01); *F21V 3/00* (2013.01); *F21Y 2107/00* (2016.08); *F21Y 2115/10* (2016.08)

(58) Field of Classification Search

CPC ..... F21K 9/232; F21K 9/238; F21Y 2107/00

See application file for complete search history.

(56) References Cited

U.S. PATENT DOCUMENTS

| | | | | |
|---|---|---|---|---|
| 9,822,933 | B2 * | 11/2017 | Rao | F21V 23/001 |
| D829,942 | S * | 10/2018 | Gao | D26/2 |
| D830,586 | S * | 10/2018 | Jiang | D26/2 |
| 10,170,294 | B2 * | 1/2019 | Fu | H01K 1/16 |
| 10,215,342 | B2 * | 2/2019 | Yang | F21K 9/232 |
| 10,234,088 | B2 * | 3/2019 | Kim | H01L 27/156 |
| 2009/0184618 | A1 * | 7/2009 | Hakata | H01L 25/0753 313/1 |
| 2013/0058080 | A1 * | 3/2013 | Ge | F21V 3/00 362/231 |
| 2016/0363267 | A1 * | 12/2016 | Jiang | F21V 29/70 |
| 2016/0369949 | A1 * | 12/2016 | Wu | H05B 35/00 |
| 2017/0051878 | A1 * | 2/2017 | Jiang | F21K 9/232 |
| 2017/0084809 | A1 * | 3/2017 | Jiang | F21K 9/232 |

(Continued)

*Primary Examiner* — William N Harris

(74) *Attorney, Agent, or Firm* — Chun-Ming Shih; Lanway IPR Services

(57) ABSTRACT

A lighting device includes a translucent shell, a core stem, a base and a light bar module. The light bar module is composed of a plurality of light bars. The core stem extends upwardly from the base. The light bar module is composed of a plurality of light bars. The present invention also provides a method of manufacturing a lighting device including: making a light bar module, making a core stem, hanging the light bar module to the core stem, installing the bulb shell, and installing the driving piece and the lamp cap. The lighting device helps to obtain a better optical effect, and makes the light bar module get a better heat dissipation condition.

17 Claims, 7 Drawing Sheets

(56) References Cited

U.S. PATENT DOCUMENTS

| | | | | |
|---|---|---|---|---|
| 2017/0130906 | A1* | 5/2017 | Jiang | H01L 33/62 |
| 2017/0227169 | A1* | 8/2017 | Jiang | F21V 9/30 |
| 2018/0045380 | A1* | 2/2018 | Li | H01L 25/00 |
| 2018/0080612 | A1* | 3/2018 | Haberkorn | F21K 9/232 |
| 2018/0106435 | A1* | 4/2018 | Wu | F21V 29/60 |
| 2018/0112832 | A1* | 4/2018 | Wu | F21K 9/238 |
| 2018/0328543 | A1* | 11/2018 | Bergmann | F21K 9/232 |
| 2019/0264878 | A1* | 8/2019 | Benshetrit | F21K 9/237 |

* cited by examiner

LIGHTING DEVICE AND MANUFACTURING METHOD THEREOF

FIELD OF THE INVENTION

The present invention is related to a lighting device and a manufacturing method thereof, and more particularly related to a LED lighting device and a manufacturing method thereof.

BACKGROUND OF THE INVENTION

As the development of the light emitting diode (LED) technology in recent years, the lighting industry has changed a lot. More and more LEDs have been applied to LED filament lights.

At present, most of the LED filament lights on the market are equipped with core stems, and a plurality of light bars are electrically connected to each other through the metal wire at the top of the core stem. The light bars connected with each other at the top of the stem are too dense to light and dissipate heat well. In view of this, it is very necessary to develop a LED filament lighting device with good lighting and heat dissipation effect.

SUMMARY OF THE INVENTION

The first embodiment of the present invention provides a lighting device. The lighting device includes a translucent shell, a base, a light bar module, a core stem, a lamp cap and a driving piece. The translucent shell may be made of all transparent or partially transparent material, such as glass or transparent plastic material.

The base is connected to the bottom of the translucent shell. The base and the bottom of the translucent shell form a cavity. The base has a closed air inlet. The base may be made of glass or plastic material.

An inert gas is filled in the cavity from the air inlet and maintained within the cavity after the air inlet is closed.

The light bar module is placed in the cavity. The light bar module is composed of a plurality of light bars, each light bar houses a plurality of LED chips. The connection part of the plurality of light bars is bent so that the light bar module forms a three-dimensional structure and the light emission directions of the plurality of light bars are not exactly same.

The core stem extends upwardly from the base. The core stem can be integrally formed with the base using a glass or plastic material. Another design, the base and the core stem can be formed separately using same material or different material, such as, both are made of glass, or the base is made of glass, the core stem is made of plastic. When the base is separately formed from the core stem, a connection structure can be provided at the junction of the base and the core stem to increase the stability of the connection. Also, in addition to the connection structure, the core stem and the base can be secured together by adhesive or heating.

The core stem has a plurality of upper extension pieces at the upper end. At least a part of bend connection portion of the plurality of light bars are connected to the upper extension pieces.

One end of the lamp cap is connected to the base. The lamp cap can be a common standard Edison lamp cap with variety of size, or other shapes that can be used to hold the relevant circuit. A structural part can be designed on the base to correspond to the lamp cap, such as groove, bump, thread light, to connect with the lamp cap.

The driving piece is placed in the lamp cap and is electrically connected to the light bar module to provide electric power required for the plurality of light bars to illuminate. For example, the driving piece may include a voltage conversion circuit, etc., when the lamp cap is mounted to the ceiling lamp holder, the external 220V voltage is converted into an operating voltage suitable for driving the LED chips. In some designs, there is an inner piece, which is made of insulating material, having a holding cavity. The driving piece is placed in the holding cavity of the inner piece, and the inner piece is mounted in the lamp cap.

In some embodiments, the core stem is made of glass, which is different from the upper extension pieces. For example, when the core stem is made of glass, the upper extension piece is made of metal, and it is a strip structure, one end of which is fitted into the glass material of the core stem and the other end extends out. This setting can increase the heat dissipation effect. Specifically, since the glass can be softened by heating and melting, the upper extension pieces can be inserted at that time. After the glass is cooled and hardened, the upper extension pieces can be stably and closely fitted in the core stem. In addition, it is also a practice to insert the upper extension pieces into the core stem by a mold. The other approach also includes providing a structure on the core stem to mount the upper extension pieces to secure the upper extension pieces to the core stem.

In some embodiments, the angle between the angle of the upper extension piece extending from the core stem and the angle of the core stem extending upwardly from the base is greater than 60 degrees. In other words, if the angle of the upper extension piece extending from the core stem is 90 degrees, the angle of the core stem extending upwardly from the base is 30 degrees to 330 degrees.

Experiments show that such an extension angle can bring a better lighting effect. However, in different embodiments, this extension angle may also be set as a different value.

In addition, the outer edge of the upper extension piece may have a bent portion for engaging the bent connection of the plurality of light bars. For example, the bent portion may be a hook-like structure, and the bent connection of the light bar may be hung on the hook-like structure. When manufacturing, the bend connection portion of the light bar may be arranged first above the upper extension piece with an automated device and then the upper end extension is bent to produce the hook-like structure. Other practices should also fall within the scope of the present invention as long as the upper extension pieces are connected to the bend connection portion of the light bar.

In addition to being hung, in order to make the bend connection portion of the light bar more securely connected with the upper extension pieces, gluing or welding at the hanging part could be used for further stabilizing the connection structure.

Alternatively, a position limiting structure may be provided at the hanging part, such as the hook-like structure described above. By means of the position limiting structure, the bend connection portion of the plurality of light bars can be prevented from slipping, thus it is no need to glue. In other words, it is possible to prevent the bend connection portion of the plurality of light bars from slipping through the position limiting structure without adding other fixing material.

In addition, in some embodiments, more than one bottom extension pieces may be included, extending from the lower end of the core stem. At least a part of bend connection portion of the plurality of light bars are connected to the bottom extension pieces.

In some embodiments, the core stem is made of glass, which is different from the upper extension pieces and bottom extension pieces, such as the upper and bottom extension pieces could be made of metallic, non-metallic, or glass with different properties The angle between the angle of the bottom extension piece extending from the core stem and the angle of the core stem extending upwardly from the base is greater than 60 degrees.

In addition, in some embodiments, the bend connection portion of the plurality of light bars are integrally formed by conductive metal materials. In other words, when manufacturing the light bar, the electrode contacts of the two connecting lightbars can be directly formed by an electric conductor. In this design, there is no need for additional welding between the light bars, and it can increase the stability, heat dissipation and electrical properties of the connection.

The integrally formed conductive metal material is flat sheet or long strip, it can maintain the bending angle after being bent by an external force. In other words, after the bend connection portion of the light bars bent by an external force, the light bar module can maintain the shape of the curved three-dimensional structure.

In addition, in some other embodiments, the bend connection portion of the plurality of light bars include conductive strips for welding the respective electrode contacts of the two connecting light bars. In this case, it was the conductive strip being bent.

In some embodiments, the upper extension pieces are made of non-metallic material, including composites, glass, plastic, etc., which are not entirely composed by metal.

In some embodiments, the plurality of light bars electrically connect to each other in series. In other words, these light bars can be pre-made into a long strip and then bent. The light bars mentioned above can be made together, for example, installing a LED chip and conductive wire, spreading phosphor powder on a large baseboard, and finally cutting it. This manufacturing method does not require additional welding at the junction of the light bars, and the overall structure is more stable, with better heat dissipation.

The other embodiment of the present invention provides a method of manufacturing a lighting device. The method of manufacturing a lighting device includes the following steps.

Make a light bar module. The light bar module is composed of a plurality of light bars, each of which houses a plurality of LED chips. The connection of the plurality of light bars is bent so that the light bar module forms a three-dimensional structure and the light emission directions of the plurality of light bars are not exactly same.

Make a core stem. A plurality of upper extension pieces are provided at the upper end of the core stem. A base is under the core stem and the base has an air inlet.

Hang the light bar module to the core stem so that at least a part of the plurality of light bars are connected to the upper extension pieces.

Install the bulb shell. So that the bulb shell is connected to the base to form a cavity. And then an inert gas is filled into the cavity from the air inlet of the base.

Install the driving piece and the lamp cap, the driving piece is placed in the lamp cap and is electrically connected to the light bar module and the lamp cap, the open end of the lamp cap is connected to the bottom of the bulb shell.

The core stem is made of glass, which is different from the upper extension pieces, heating the core stem to fit it into the upper extension pieces.

The invention has the advantages that the upper extension pieces can be arranged by the above-mentioned way, so that the light bar module can be relatively scattered at the upper end of the core stem, which not only helps to obtain a better optical effect, but also makes the light bar module to get a better heat dissipation condition.

DETAILED DESCRIPTION

Figure 1:
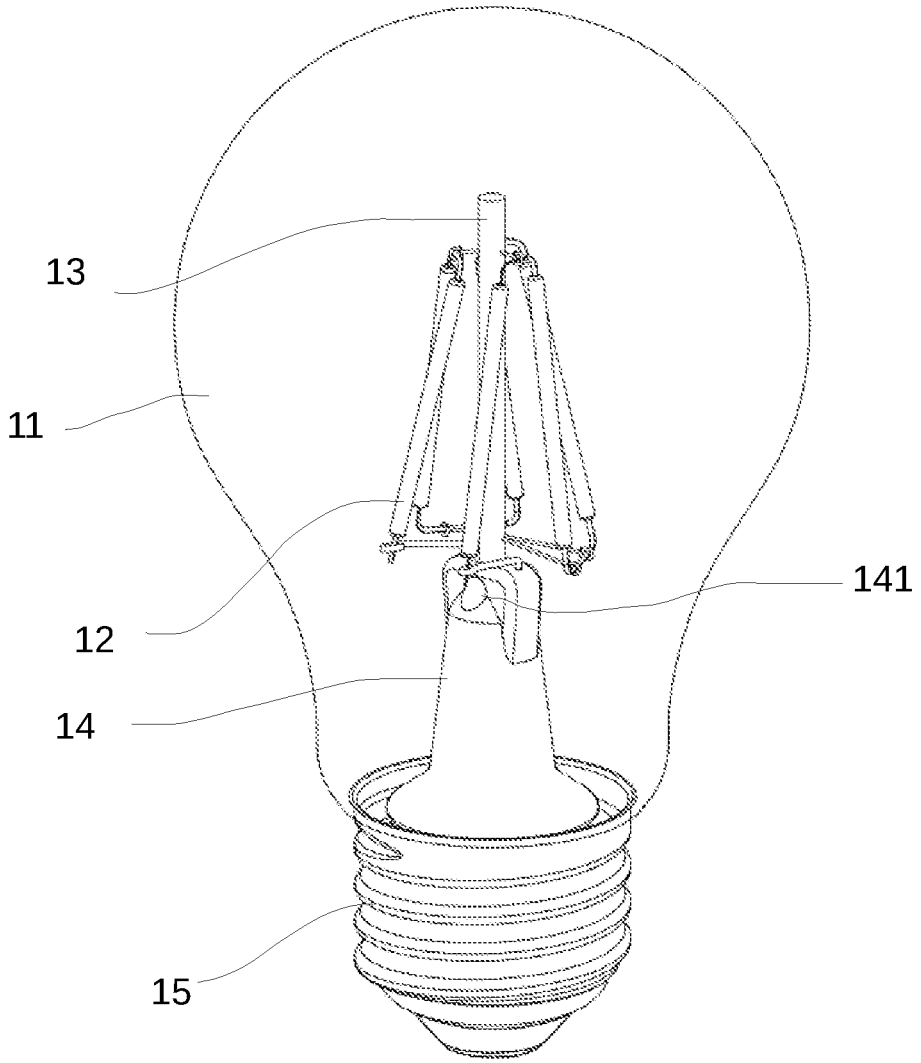
FIG. 1 illustrates an embodiment of a lighting device.
Figure 2:
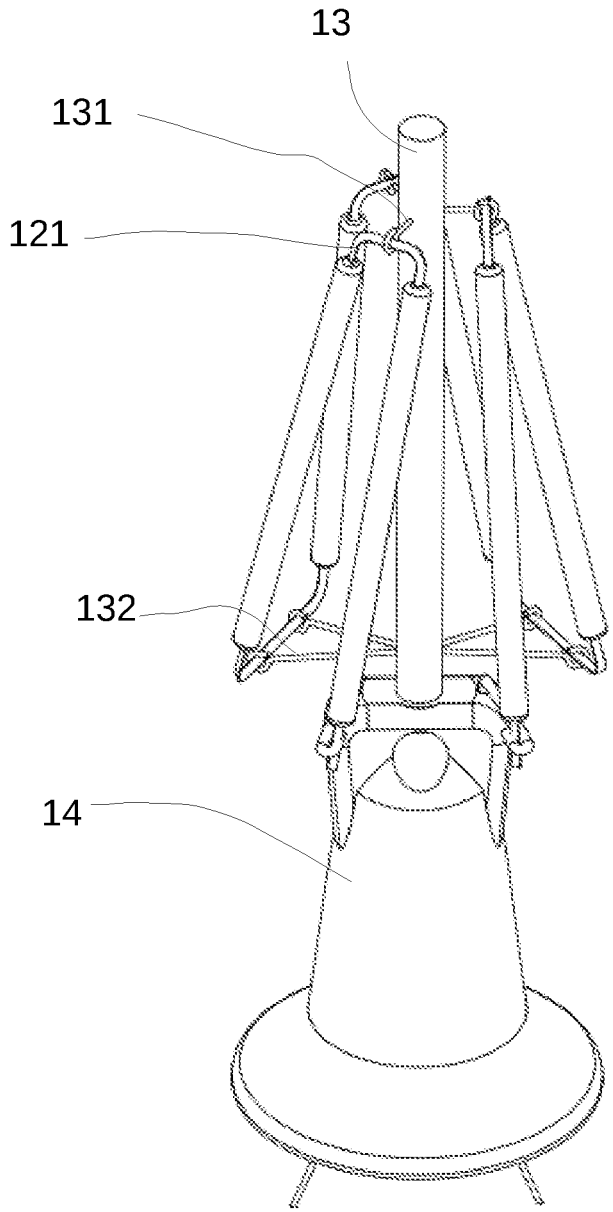
FIG. 2 illustrates an embodiment of the core stem, the light bar module and the base.
Figure 3:
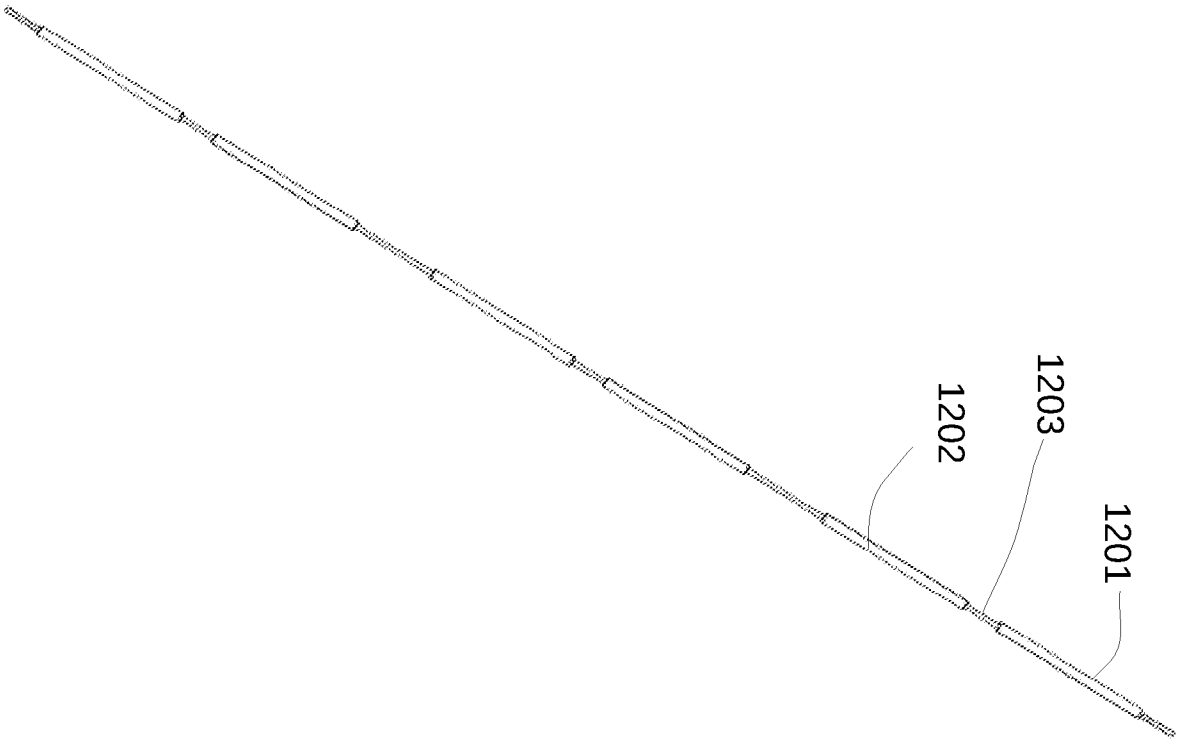
FIG. 3 illustrates a schematic view of a plurality of light bars that are not bent.
Figure 4:
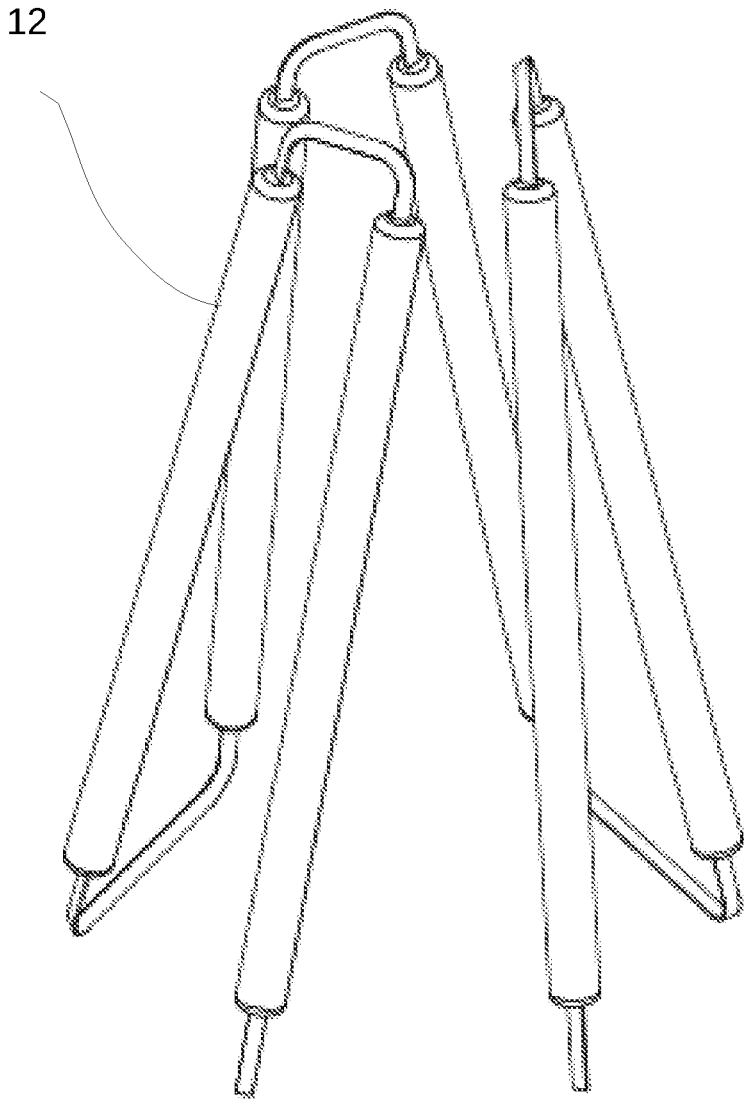
FIG. 4 illustrates a schematic view of a plurality of light bars that are bent into a three-dimensional structure.
Figure 5:
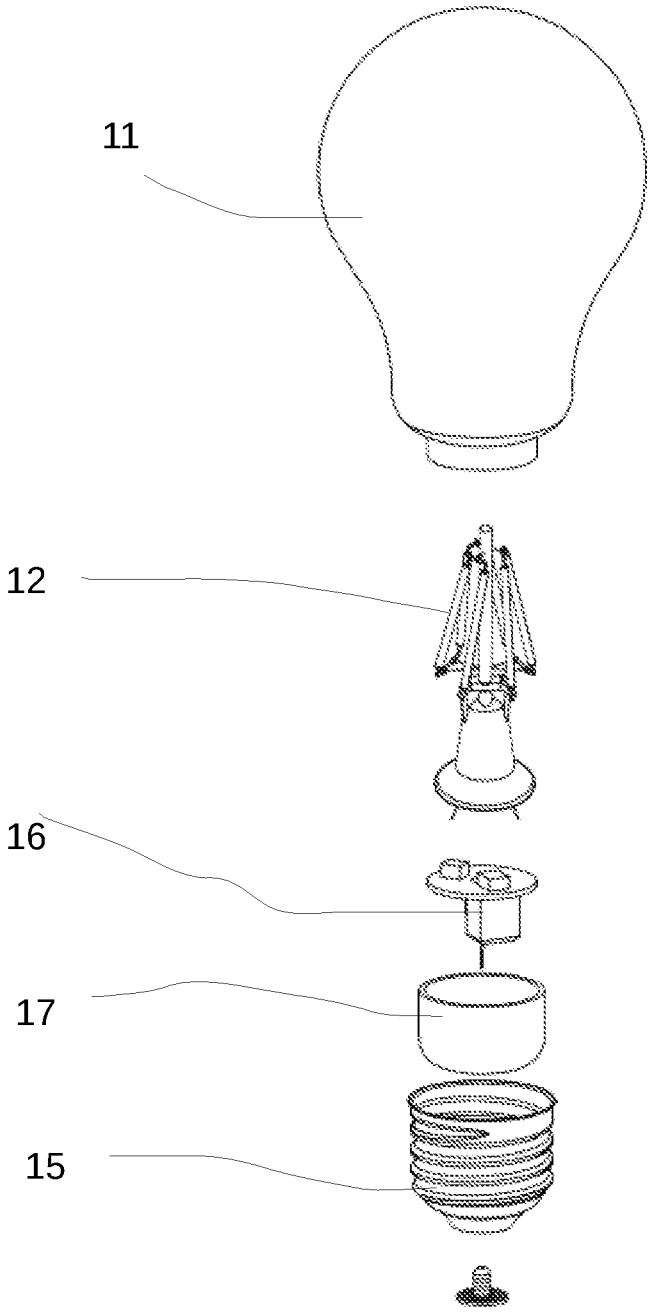
FIG. 5 illustrates an exploded view of assembling a lighting device.
Figure 6:
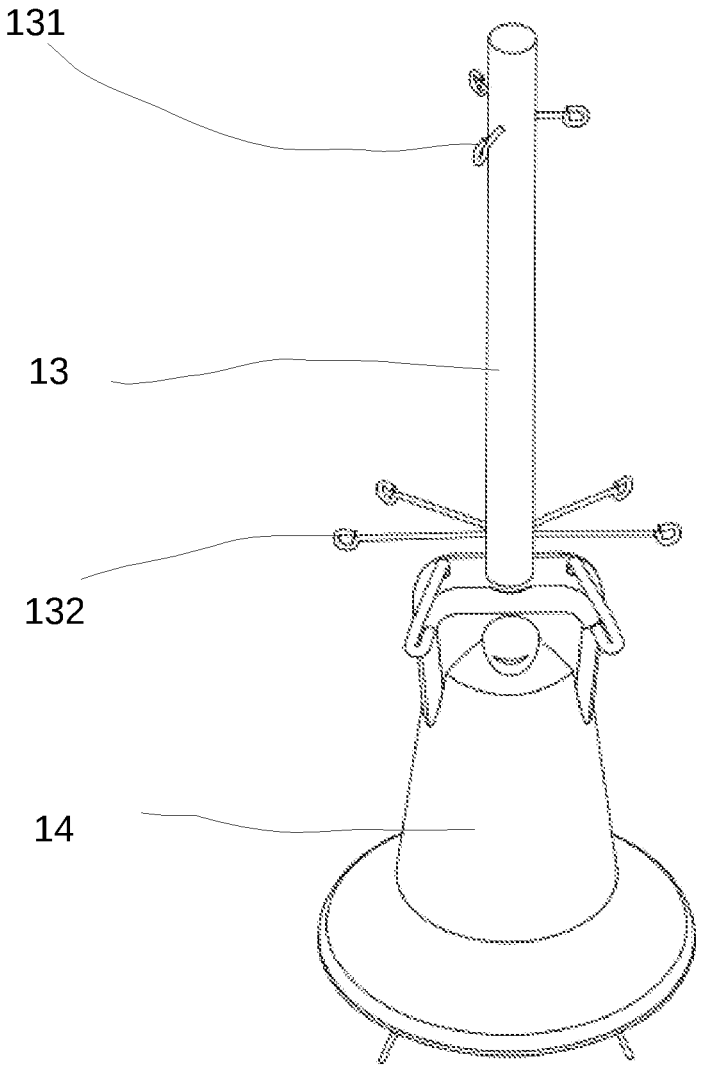
FIG. 6 illustrates a schematic view of the core stem and the base.

Please refer to FIG. 1 to FIG. 6, FIG. 1 illustrates an embodiment of a lighting device. FIG. 2 illustrates an embodiment of the core stem, the light bar module and the base. FIG. 3 illustrates a schematic view of a plurality of light bars that are not bent. FIG. 4 illustrates a schematic view of a plurality of light bars that are bent into a three-dimensional structure. FIG. 5 illustrates an exploded view of assembling a lighting device. FIG. 6 illustrates a schematic view of the core stem and the base.

Please refer to FIG. 1 to FIG. 6, the first embodiment of the present invention provides a lighting device, comprising a translucent shell 11, a base 14, a light bar module 12, a core stem 13, a lamp cap 15 and a driving piece 16. The translucent shell 11 may be made of all transparent or partially transparent material, such as glass or transparent plastic material.

The base 14 is connected to the bottom of the translucent shell 11 and forms a cavity, having a closed air inlet 141. The base 14 may be made of glass or plastic material.

An inert gas enters the cavity from the air inlet 141 and maintained within the cavity after the air inlet 141 is closed.

The light bar module 12 is placed in the cavity. The light bar module 12 is composed of a plurality of light bars 1201, 1202, each light bar 1201, 1202 houses a plurality of LED chips. The connection part of the plurality of light bars is bent so that the light bar module forms a three-dimensional structure and the light emission directions of the plurality of light bars 1201, 1202 are not exactly same.

The core stem 13 extends upwardly from the base 14. The core stem 13 can be integrally formed with the base 14 using a glass or plastic material. Another design, the base 14 and the core stem 13 can be formed separately using same material or different material, such as, both are made of glass, or the base is made of glass, the core stem is made of plastic. When the base 14 is separately formed from the core stem 13, a connection structure can be provided at the junction of the base 14 and the core stem 13 to increase the stability of the connection. Also, in addition to the connection structure, the core stem 13 and the base 14 can be secured together by adhesive or heating.

The core stem 13 has a plurality of upper extension pieces 131 at the upper end. At least a part of bend connection portion 121 of the plurality of light bars are connected to the upper extension pieces 131.

One end of the lamp cap 15 is connected to the base 14. The lamp cap 15 can be a common standard Edison lamp cap with variety of size, or other shapes that can be used to hold the relevant circuit. A structural part can be designed on the base 14 to correspond to the lamp cap 15, such as groove, bump, thread light, to connect with the lamp cap 15.

The driving piece 16 is placed in the lamp cap 15 and is electrically connected to the light bar module 12 to provide electric power required for the plurality of light bars to illuminate. For example, the driving piece 16 may include a voltage conversion circuit, etc., when the lamp cap 15 is mounted to the ceiling lamp holder, the external 220V voltage is converted into an operating voltage suitable for driving the LED chip. Please refers to FIG. 5, in some designs, there is an inner piece 17, which is made of insulating material, having a holding cavity. The driving piece 16 is placed in the holding cavity of the inner piece 17, and the inner piece 17 is mounted in the lamp cap 15.

In some embodiments, the core stem 13 is made of glass, which is different from the upper extension pieces 131. For example, when the core stem 13 is made of glass, the upper extension piece 131 is made of metal, and it is a strip structure, one end of which is fitted into the glass material of the core stem 13 and the other end extends out. This setting can increase the heat dissipation effect. Specifically, since the glass can be softened by heating and melting, the upper extension pieces 131 can be inserted at this time. After the glass is cooled and hardened, the upper extension pieces 131 can be stably and closely fitted in the core stem 13. In addition, it is also a practice to insert the upper extension pieces 131 into the core stem 13 by a mold. The other approach also includes providing a structure on the core stem 13 to mount the upper extension pieces 131 to secure the upper extension pieces 131 to the core stem 13.

In some embodiments, the angle between the angle of the upper extension piece extending from the core stem and the angle of the core stem extending upwardly from the base is greater than 60 degrees. In other words, if the angle of the upper extension piece extending from the core stem is 90 degrees, the angle of the core stem extending upwardly from the base is 30 degrees to 330 degrees.

Experiments show that such an extension angle can bring a better lighting effect. However, in different embodiments, this extension angle may also be set as a different value.

In addition, the outer edge of the upper extension piece 131 may have a bent portion for hanging the bent connection portion 121 of the plurality of light bars. For example, the bent portion may be a hook-like structure, and the bent connection portion of the light bar may be hung on the hook-like structure. When manufacturing, the bend connection portion 121 of the light bar may be arranged first above the upper extension piece 131 with an automated device and then the upper extension 131 is bent to produce the hook-like structure. Other practices should also fall within the scope of the present invention as long as the upper extension pieces 131 are connected to the bend connection portion 121 of the light bar.

In addition to being hung, in order to make the bend connection portion 121 of the light bar more securely connected with the upper extension pieces 131, gluing or welding at the hanging part could be used for further stabilizing the connection structure.

Alternatively, a position limiting structure may be provided at the hanging part where the bend connection portion 121 of the light bar connects to the upper extension pieces 131, such as the hook-like structure described above. By means of the position limiting structure, the bend connection portion of the plurality of light bars can be prevented from slipping, thus it is no need to glue. In other words, it is possible to prevent the bend connection portion of the plurality of light bars from slipping through the position limiting structure without adding other fixing material. Through providing the upper end extension pieces 131, the light bar modules 12 relatively scatter at the upper end of the core stem 13. It not only helps to obtain a better optical effect, but also makes the light bar module 12 to get a better heat dissipation condition.

In addition, in some embodiments, more than one bottom extension pieces 132 may be included, extending from the lower end of the core stem 13. At least a part of bend connection portion of the plurality of light bars are connected to the bottom extension pieces 132.

In some embodiments, the core stem 13 is made of glass, which is different from the upper extension pieces 131 and bottom extension pieces 132, such as the upper and bottom extension pieces could be made of metallic, non-metallic, or glass with different properties.

The angle between the angle of the bottom extension piece 132 extending from the core stem 13 and the angle of the core stem 13 extending upwardly from the base is greater than 60 degrees.

In addition, in some embodiments, the bend connection portion 121 of the plurality of light bars are integrally formed by conductive metal materials. In other words, when manufacturing the light bar, the electrode contacts of the two connecting light bars 1201, 1202 can be directly formed by an electric conductor 1203. In this design, there is no need for additional welding between the light bars, and it can increase the stability, heat dissipation and electrical properties of the connection.

The integrally formed conductive metal material is flat sheet or long strip, it can maintain the bending angle after being bent by an external force. In other words, after the bend connection portion of the light bars bent by an external force, the light bar module can maintain the shape of the curved three-dimensional structure.

In addition, in some other embodiments, the bend connection portion of the plurality of light bars comprise conductive strips for welding the respective electrode contacts of the two connecting light bars. In this case, it was the conductive strip being bent.

In some embodiments, the upper extension pieces 131 are made of non-metallic material, including composites, glass, plastic, etc., which are not entirely composed by metal.

In some embodiments, the plurality of light bars constitute an electrical connection in series, shown as FIG. 3. In other words, these light bars can be pre-made into a long strip and then bent. The light bars mentioned above can be made together, for example, installing a LED chip and conductive wire, spreading phosphor powder on a large baseboard, and finally cutting it. This manufacturing method does not require additional welding at the junction of the light bars, and the overall structure is more stable, with better heat dissipation.

Figure 7:
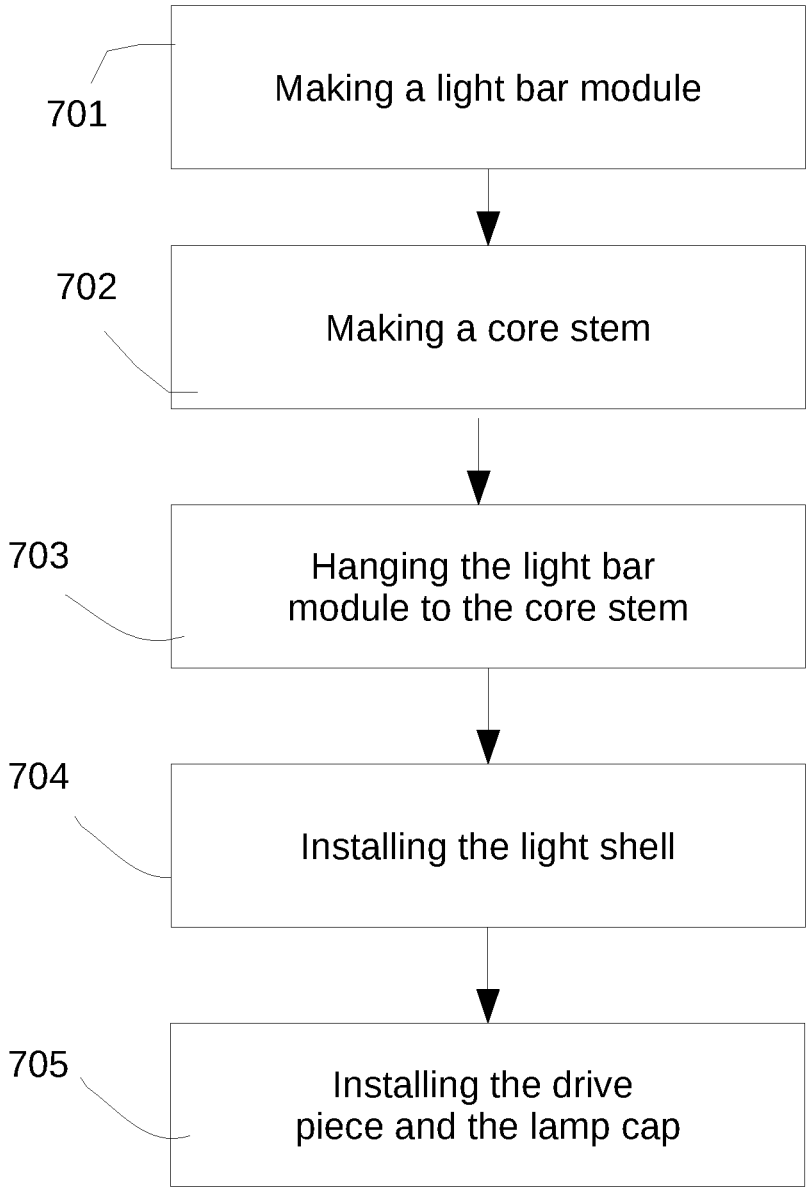
FIG. 7 illustrates a flow chart of a method of assembling a lighting device.

Please refers to FIG. 7. FIG. 7 illustrates a flow chart of a method of assembling a lighting device. The method includes the following steps.

Make a light bar module (step 701). The light bar module is composed of a plurality of light bars, each light bar houses a plurality of LED chips. The connection part of the plurality of light bars is bent so that the light bar module forms a three-dimensional structure and the light emission directions of the plurality of light bars are not exactly same.

Make a core stem (step 702). A plurality of upper end extension pieces are provided at the upper end of the core stem. A base is set under the core stem, and the base has an air inlet.

Hang the light bar module to the core stem (step 703), so that at least a bent portion of the plurality of light bars is connected to the upper extension pieces.

Install the bulb shell (step 704), so that the bulb shell is connected to the base to form a cavity. And then filling an inert gas into the cavity from the air inlet of the base.

Install the driving piece and the lamp cap (step 705). The driving piece is placed in the lamp cap and is electrically connected to the light bar module and the lamp cap, the open end of the lamp cap is connected to the bottom of the bulb shell.

The core stem is made of glass, which is different from the upper extension pieces, heating the core stem to fit it into the upper extension pieces.

In addition to the above-described embodiments, any modifications, as long as it is within the spirit of the same invention, the various designs that can be made by a person skilled in the art should fall within the scope of the present invention.

The invention claimed is:

1. A lighting device, comprising:

a translucent shell for passing light through;

a base, connecting to a bottom of the translucent shell and having a cavity with the translucent shell, having a closed air inlet;

an inert gas, entering the cavity from the air inlet when fabricating and maintained within the cavity after the air inlet being closed;

a light bar module, placed in the cavity, the light bar module being composed of a plurality of light bars, each light bar housing a plurality of LED chips, the plurality of light bars being connected as a series connection where two adjacent light bars of the plurality of light bars are connected with one connection part, said one connection part being not further connected to a third light bar not adjacent to said two adjacent light bars, the connection part of said two light bars being bent to form a bend connection portion so that the light bar module forms a three-dimensional structure and makes light emission directions of the plurality of light bars different;

a core stem, having a plurality of upper extension pieces at an upper end, at least a portion of the bend connection portion of the plurality of light bars connected to the upper extension pieces;

a lamp cap, one end of the lamp camp connected to the base; and a driving piece, placed in the lamp cap and electrically connected to the light bar module to provide electric power required for the plurality of light bars to illuminate, wherein an outer edge of each upper extension piece has a bent portion for respectively engaging one bend connection portion of corresponding light bars.

2. The lighting device of claim 1, wherein the core stem is made of glass, and a material of the core stem is different from that of the upper extension pieces.

3. The lighting device of claim 1, wherein the core stem is made of glass, the upper extension piece is made of metal, and part of the upper extension pieces is fitted into the glass material of the core stem to increase heat dissipation.

4. The lighting device of claim 1, wherein the bent portion of the upper extension pieces hung to the bend connection portion of the plurality of light bars is provided with gluing material.

5. The lighting device of claim 1, wherein the bent portion of the upper extension pieces hung to the bend connection portion of the plurality of light bars is provided with welding material.

6. The lighting device of claim 1, wherein the bent portion of the upper extension pieces hung to the bend connection portion of the plurality of light bars is provided with a position limiting structure to prevent the bend connection portion of the plurality of light bars from slipping.

7. The lighting device of claim 6, wherein the position limiting structure is the only structure used to prevent the bend connection portion of the plurality of light bars from slipping at the bend connection portion of the plurality of light bars.

8. The lighting device of claim 1, further comprising a plurality of bottom extension pieces, extending from a lower end of the core stem, at least a part of the bend connection portion of the plurality of light bars connected to the bottom extension pieces.

9. The lighting device of claim 8, wherein the core stem is made of glass, a material of the core stem is different from the bottom extension pieces.

10. The lighting device of claim 1, wherein the bend connection portion of the plurality of light bars is made of integrated conductive metal material.

11. The lighting device of claim 10, wherein the integrated conductive metal material is a flat sheet, and maintains a bending angle after being bent by an external force.

12. The lighting device of claim 10, wherein the integrated conductive metal material is a long strip, and maintains a bending angle after being bent by an external force.

13. The lighting device of claim 1, wherein the bend connection portion of the plurality of light bars is provided with conductive strips for welding the electrode contacts of two connecting light bars.

14. The lighting device of claim 13, wherein the upper extension pieces are made of non-metallic material.

15. The lighting device of claim 1, wherein the plurality of light bars electrically connect to each other in series.

16. A method of manufacturing a lighting device, comprising:

making a light bar module, the light bar module composed of a plurality of light bars, each light bar housing a plurality of LED chips, the plurality of light bars being connected as a series connection where two adjacent light bars of the plurality of light bars are connected with one connection part, said one connection part being not further connected to a third light bar not adjacent to said two adjacent light bars, the connection parts of the plurality of light bars being bent so that the light bar module forms a three-dimensional structure and makes light emission directions of the plurality of light bars different;

making a core stem, the core stem provided with a plurality of upper extension pieces at an upper end, a base at a bottom, the base having an air inlet, wherein an outer edge of each upper extension piece has a bent portion for respectively engaging the bend connection of corresponding light bar;

installing the bulb shell to connect to the base to form a cavity; and filling an inert gas to the cavity from the air inlet of the base.

17. The method for fabricating a lighting device of claim 16, wherein the core stem is made of glass, a material of the core stem is different from the upper extension pieces, and heating the glass of the core stem to fit into the upper extension pieces.

* * * * *